US006905018B2

(12) United States Patent
Darcy, III et al.

(10) Patent No.: US 6,905,018 B2
(45) Date of Patent: Jun. 14, 2005

(54) PACKAGING APPARATUS FOR WRAPPING AND FOLDING FLEXIBLE PHOTORECEPTOR BELTS

(75) Inventors: John J. Darcy, III, Webster, NY (US); David W. Martin, Walworth, NY (US); Michael S. Roetker, Webster, NY (US); James F. Dildine, Jr., Williamson, NY (US); Moritz P. Wagner, Walworth, NY (US); J. Stephen Olesiuk, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 57 days.

(21) Appl. No.: 10/625,192

(22) Filed: Jul. 23, 2003

(65) Prior Publication Data

US 2005/0016885 A1 Jan. 27, 2005

(51) Int. Cl.[7] ..... B65D 85/02
(52) U.S. Cl. ..... 206/303; 206/389
(58) Field of Search ..... 206/303, 389, 206/393, 449, 455, 493; 430/500, 501; 399/164

(56) References Cited

U.S. PATENT DOCUMENTS 709,053 A * 9/1902 Shaw ..... 430/501
1,784,366 A * 12/1930 Littlefield ..... 53/397
2,188,779 A * 1/1940 Roehri ..... 430/501
2,630,385 A * 3/1953 Wolff ..... 430/500
2,732,063 A * 1/1956 Dedek et al. ..... 206/410
3,022,170 A * 2/1962 Flinchbaugh et al. ..... 430/501
3,942,637 A * 3/1976 Glennie ..... 206/389
3,986,879 A * 10/1976 Klinkhammer ..... 430/501
4,162,009 A * 7/1979 Schouten ..... 206/389
5,119,133 A * 6/1992 Swain ..... 399/163
5,282,345 A * 2/1994 Darcy et al. ..... 53/118
5,536,094 A * 7/1996 Kondo ..... 400/247
5,790,912 A * 8/1998 Myers ..... 396/511

* cited by examiner

*Primary Examiner*—Mickey Yu
*Assistant Examiner*—Jerrold Johnson
(74) *Attorney, Agent, or Firm*—Tallam I. Nguti

(57) ABSTRACT

Packaging apparatus is provided for packaging a flexible photoconductive belt loop to prevent light from shocking the flexible photoconductive belt loop during shipping and during loading into an image reproduction machine. The packaging apparatus includes (a) a cut sheet of light occluding and protective flexible member for wrapping over the flexible photoconductive belt loop. The cut sheet has a length L2 including a first end, a second end, and (iv) at least one loop tacking aperture formed through a second end portion thereof. The packaging apparatus also includes a first adhesive tape member applied over the second end portion, through the at least one loop tacking aperture, and onto a first end portion. The packaging apparatus further includes a plurality of packaging cores, and a second adhesive tape member applied over the second end and over a portion of the main body portion.

15 Claims, 6 Drawing Sheets

PACKAGING APPARATUS FOR WRAPPING AND FOLDING FLEXIBLE PHOTORECEPTOR BELTS

RELATED CASE

This application is related to U.S. application Ser. No. 10/625,206 U.S. Pat. No. 6,851,249 entitled "PACKAGING MACHINE AND METHOD FOR WRAPPING AND FOLDING FLEXIBLE PHOTORECEPTOR BELTS" filed on even date herewith, and having at least one common inventor.

The present invention relates generally to flexible photoreceptor belts, and more particularly to a packaging apparatus for wrapping and folding a flexible photoconductive belt loop so as to prevent light from shocking it during shipping and during loading into an image producing machine, such as an electrostatographic image reproduction machine.

In the art of electrostatography, a photoconductive member including an insulating photoconductive layer on a conductive layer is imaged by first electrostatically charging the imaging surface of the photoconductive insulating layer. The photoconductive member is then exposed to a pattern of activating electromagnetic radiation such as light, which selectively dissipates the charge in the illuminated areas of the photoconductive insulating layer while leaving behind an electrostatic latent image in the non-illuminated area. This electrostatic latent image may then be developed to form a visible image by depositing finely divided electroscopic toner particles on the surface of the photoconductive insulating layer. The resulting visible toner image can be transferred to a suitable receiving member such as paper. This imaging process may be repeated many times with reusable photoconductive insulating layers.

As is well known, the photoconductive member may be in the form of a flexible photoreceptor belt. These flexible belts have a substrate and sensitive layers that include an electrically conductive surface and at least one photoconductive layer. A common flexible photoreceptor belt comprises a substrate, a conductive layer, an optional hole blocking layer, an optional adhesive layer, a charge generating layer, a charge transport layer and, in some embodiments, an anti-curl backing layer.

These photoreceptor belts are usually thin and flimsy, but most importantly, they are very sensitive to light. Accordingly, during handling of these belts when shipping or loading them into an image reproduction machine, damage such as scratches, dents can result, and light shock can result if the belts are exposed for significant periods to light. Such damage ordinarily can lead to degradation in the quality of images produced thereon by the reproduction machine.

There is therefore a need for packaging apparatus that can wrap and fold a flexible photoconductive belt loop so as to prevent light from shocking it during shipping and during loading into an image producing machine.

In accordance with the present invention, there is provided a packaging apparatus for packaging a flexible photoconductive belt loop to prevent light from shocking the flexible photoconductive belt loop during shipping and during loading into an image reproduction machine. The packaging apparatus includes (a) a cut sheet of light occluding and protective flexible member for wrapping over the flexible photoconductive belt loop. The cut sheet has a length L2 including a first end, a second end, and (iv) at least one loop tacking aperture formed through a second end portion thereof. The packaging apparatus also includes a first adhesive tape member applied over the second end portion, through the at least one loop tacking aperture, and onto a first end portion. The packaging apparatus further includes a plurality of packaging cores, and a second adhesive tape member applied over the second end and over a portion of the main body portion.

In the detailed description of the invention presented below, reference is made to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
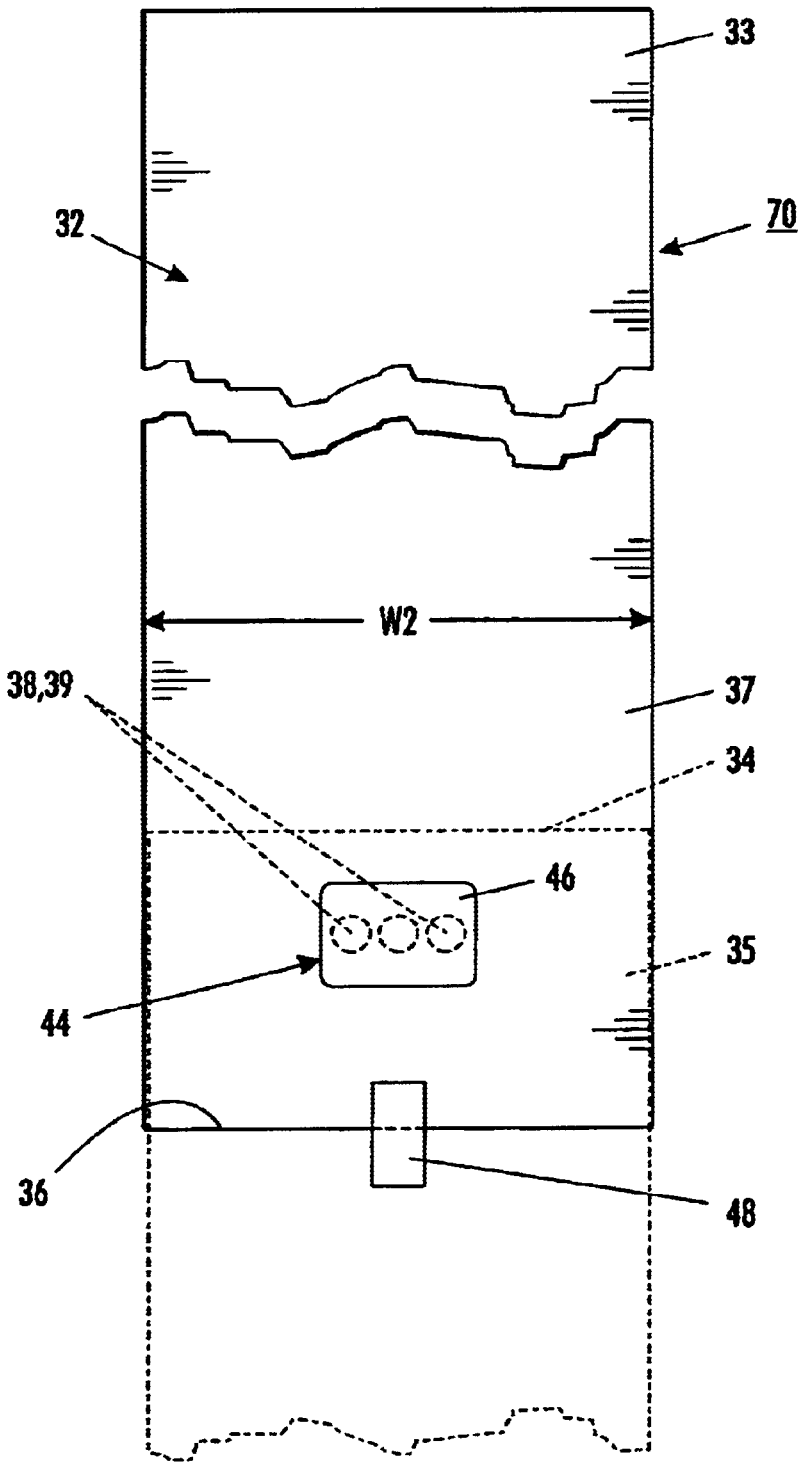
FIG. 1 is a schematic illustration of a part of the folded flexible photoconductive belt loop using the packaging apparatus of the present invention.
Figure 2:
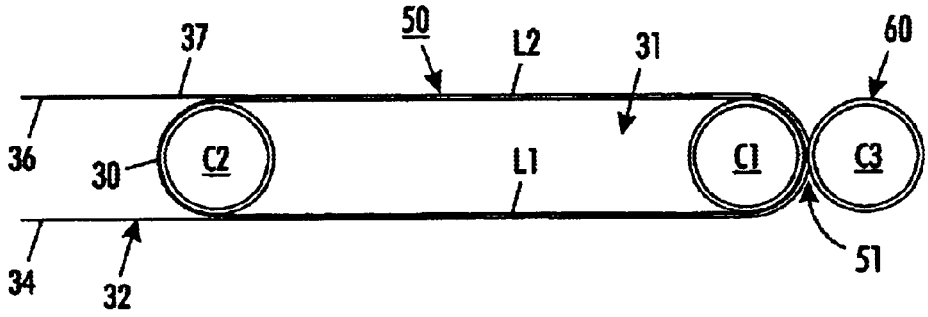
FIGS. 2–6 are schematic illustrations of the folding of the flexible photoconductive belt loop using the packaging apparatus of the present invention.
Figure 3:
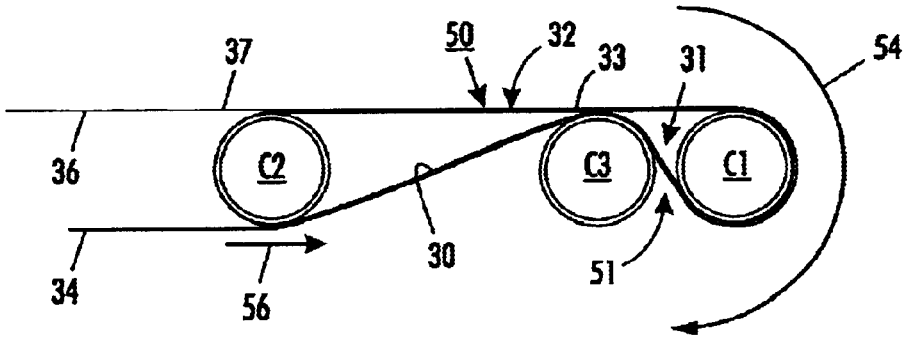
Figure 4:
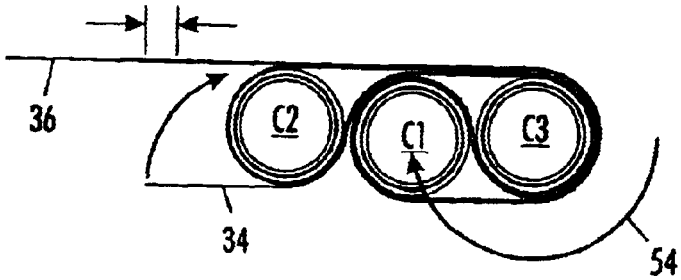
Figure 5:
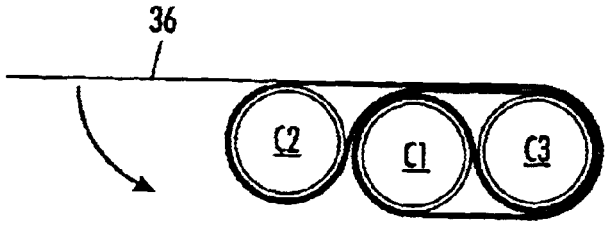

Referring to FIG. 1, it schematically illustrates the packaging apparatus 20 of the present invention. The packaging apparatus 20 is suitable for packaging a flexible photoconductive belt loop 30 that has a width W1 and circumference L1, to prevent light from shocking the flexible photoconductive belt loop 30 during shipping and during loading into an image reproduction machine. The packaging apparatus 20 includes a cut sheet of light occluding and protective flexible member 32 for wrapping over an external surface of the flexible photoconductive belt loop 30. The cut sheet of light occluding and protective flexible member 32 has a width W2, and a length L2 that includes (i) a main body portion 33, (ii) a first end 34 and a first end portion 35 adjacent the main body portion and the first end, (iii) a second end 36 and a second end portion 37 adjacent the main body portion and the second end, and (iv) at least one loop tacking aperture 38, 39 formed through the second end portion 37 of the cut sheet of light occluding and protective flexible member 32.

The packaging apparatus 20 also includes a first adhesive tape member 44 applied over the second end portion 37, through the at least one loop tacking aperture 38, 39, and onto the first end portion 35 of the cut sheet of light occluding and protective flexible member 32 to form a protective loop 40 thereof around the flexible photoconductive belt loop 30. The protective loop 40 and the flexible photoconductive belt loop 30 together form a wrapped assembly 50.

The packaging apparatus 20 further includes a second adhesive tape member 48, in the form of a removable pull tab, for applying over the second end 36 of the cut sheet of light occluding protective flexible member 32, and over a section of the main body portion 33 of the cut sheet of light occluding protective flexible member 32 when assembled into the wrapped assembly 50 and folded in accordance with the present invention as described below.

In one embodiment, the light occluding protective flexible member 32 comprises photo paper, and specifically black photo paper. The total length L3 of the light occluding protective flexible member 32 is significantly greater than the circumference L1 of the flexible photoconductive belt loop 30, thus allowing for overlapping first and second end portions 35, 37.

Figure 8:
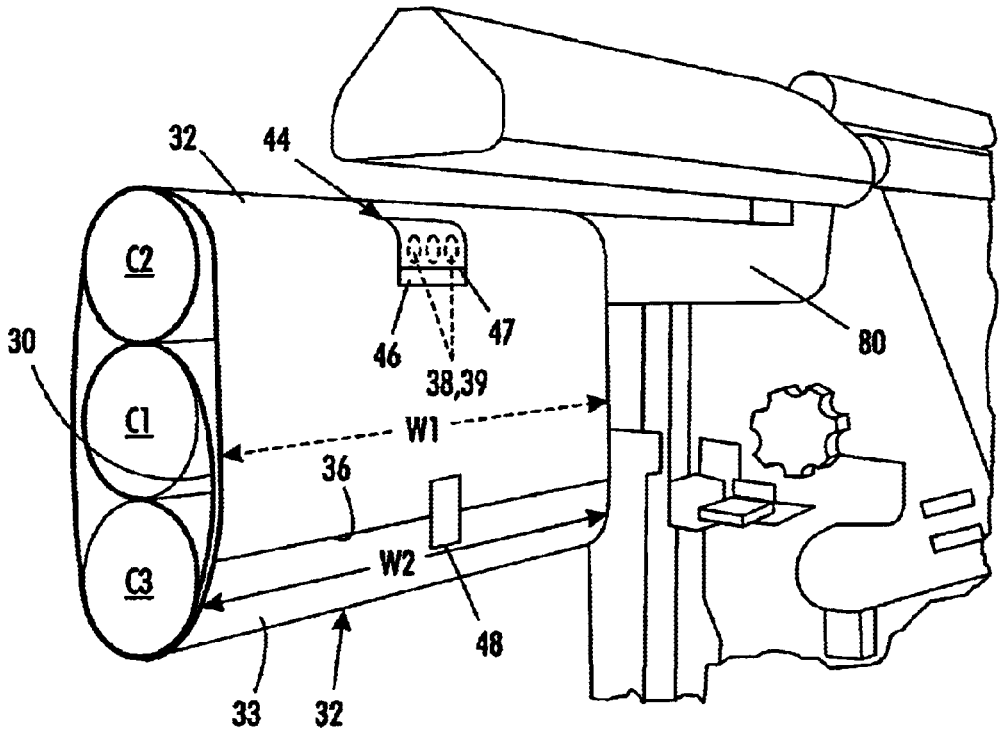
FIG. 8 is a perspective illustration of the tightly folded flexible photoconductive belt loop about to be unfolded for loading into an image reproduction machine.

In accordance with an aspect of the present invention, the first adhesive tape 44, (as shown in FIGS. 1 and 8), has an adhesive bottom surface and a printable top surface 46 including printed instructions 47 for handling the folded flexible photoconductive belt loop 30 for installation in an image reproduction machine. Further, the at least one loop tacking aperture 38, 39 comprised two, and are formed centered relative to the width W2.

Referring now to FIGS. 2–9, the packaging apparatus 20 further includes a plurality 60 of cylindrical packaging core members C1, C2, C3, made for example, of paper, for supporting and forming the wrapped assembly 50 (of the flexible photoconductive belt loop 30 and the light occluding protective flexible member 32) into a tightly folded assembly 70 thereof. The plurality 60 for example comprises three cylindrical packaging core members, and includes first and second cylindrical packaging core members C1, C2 located on the inside 31 of the flexible photoconductive belt loop 30 for stretching and tensioning the wrapped assembly 50 into a length L4 approximately one-half L1. The plurality 60 also the third cylindrical packaging core C3 located on the outside 51 of the wrapped assembly 50 for folding the wrapped assembly around one (C1) of the first and second cylindrical packaging cores C1, C2 into the tightly folded assembly 70 thereof.

Figure 6:
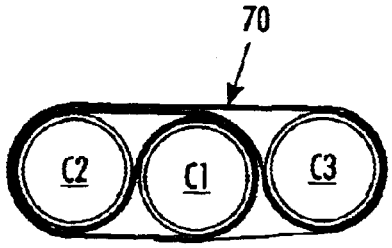
Figure 7:
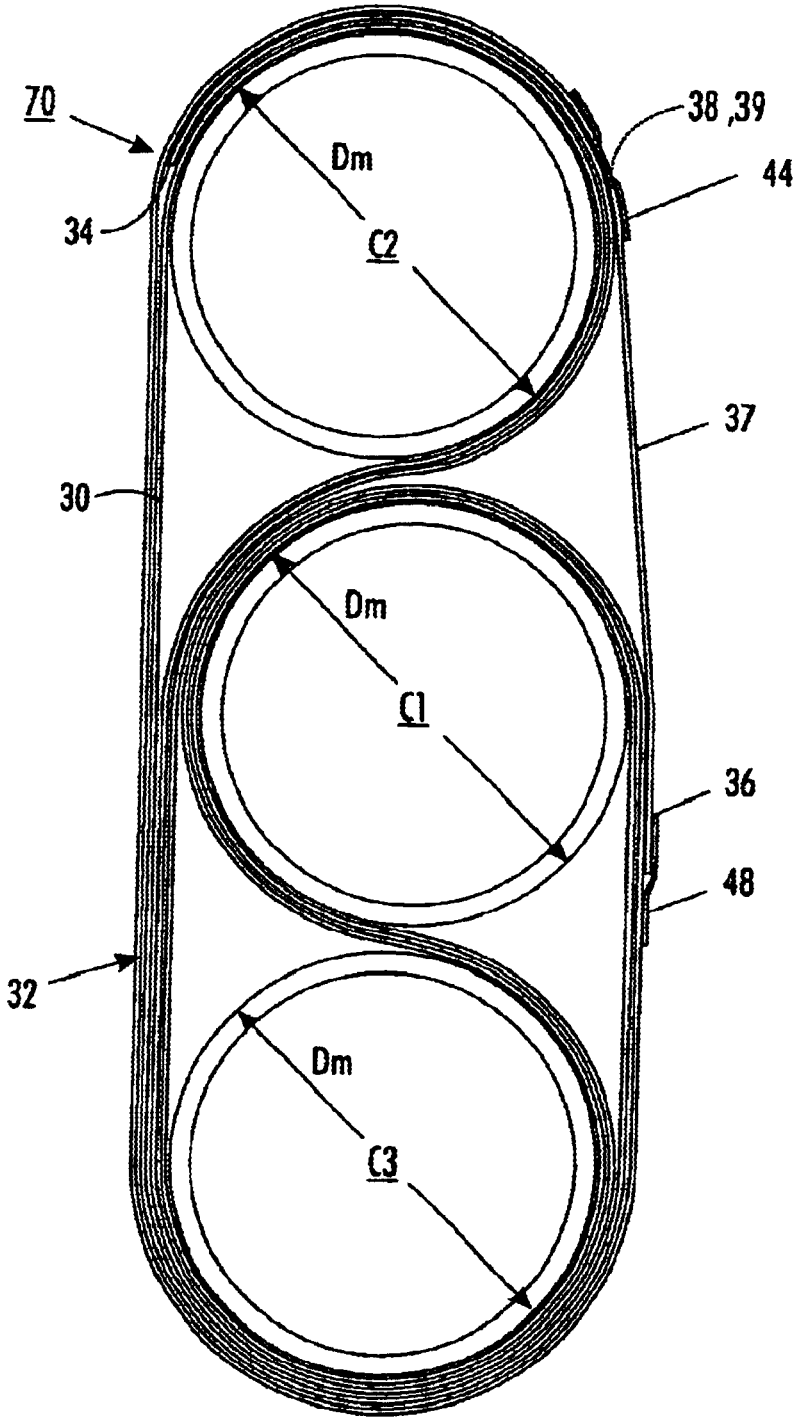
FIG. 7 is an end view illustration of the tightly folded flexible photoconductive belt loop using the packaging apparatus of the present invention.

In accordance with the present invention, each of the cylindrical packaging core members C1, C2, C3 has a diameter Dm that is selected such that these first, second and third cylindrical packaging cores will be linearly aligned as shown in FIGS. 6–7 when the wrapped assembly 50 is folded around a couple of them into the tightly folded assembly 70.

Figure 9:
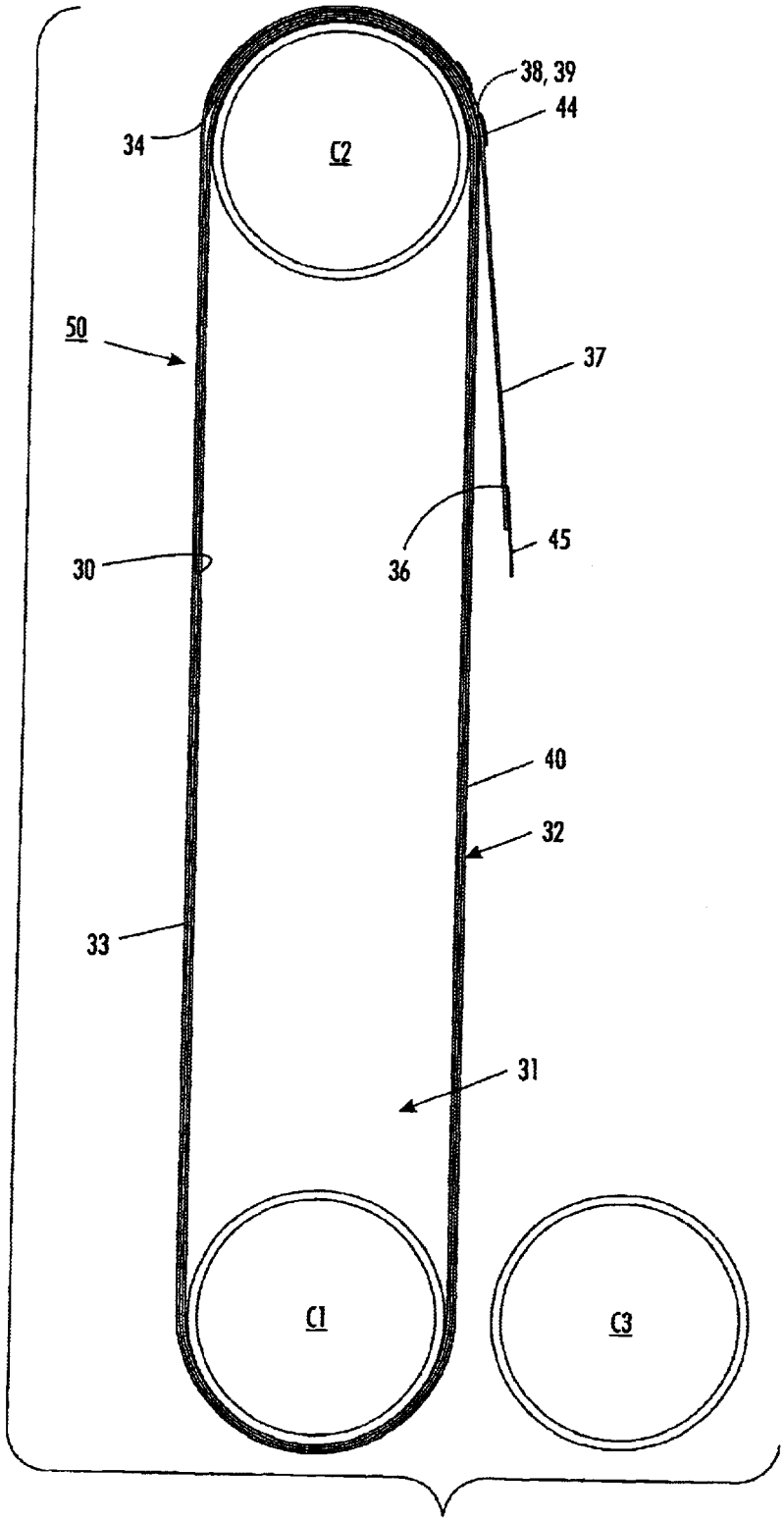
FIG. 9 is an end view illustration of the flexible photoconductive belt loop unfolded and ready for loading into an image reproduction machine, and yet still wrapped in accordance with the present invention.

In general, FIG. 1 is a schematic illustration of a part of the tightly folded assembly 70 of flexible photoconductive belt loop 30 using the packaging apparatus of the present invention. FIGS. 2–6 are illustrations of the folding of the flexible photoconductive belt loop 30 using the packaging apparatus of the present invention. As shown, the wrapped assembly 50 is folded along arrow 54 and 56 around the packaging cores C3 and C1. FIG. 7 is an end view of the tightly folded assembly 70 of flexible photoconductive belt loop and the packaging apparatus of the present invention. FIG. 8 is a perspective illustration of the tightly folded assembly 70 about to be unfolded for loading into an image reproduction machine, and FIG. 9 is an end view of the wrapped assembly 50 (of the flexible photoconductive belt loop 30 and packaging apparatus of the present invention) unfolded and ready for loading into an image reproduction machine, and yet still wrapped with the protective loop 40 in accordance with the present invention Referring specifically now to FIGS. 8 and 9, in order to install the flexible photoconductive belt loop 30 into an image reproduction machine without risk of light shock, the second packaging core C2 of the tightly folded assembly 70 thereof is inserted over a mandrel type member 80 located at a height greater than one-half L1 above a floor surface. This exposes the trail end 36 and the second adhesive tape or pull tab 48 as shown. Above the pull tab 48, the loop tacking and label adhesive tape 44 is located with the instructions 47 clearly visible. Peeling back or removing the pull tab 48 (as shown in FIG. 9) will immediately allow the folded sections of the wrapped assembly 50 to unfold and drop into a straight-down hanging wrapped loop as shown. The unfolding and dropping will free the third packaging core C3 (which initially was external to the wrapped loop 50) to fall free, but leave the other core C1 inside the flexible photoconductive belt loop 30, at the very bottom of the hanging wrapped loop 50. With the loop tacking adhesive tape 44 still applied, the light occluding flexible member 32 is thus still intact as a protective loop 40 over the flexible photoconductive belt loop 30, and the two loops together (as the wrapped loop 50) can be moved and handled for installation in an image reproduction machine (not shown) without risk of light shock to the flexible photoconductive belt loop 30.

As can be seen, there has been provided a packaging apparatus for packaging a flexible photoconductive belt loop to prevent light from shocking the flexible photoconductive belt loop during shipping and during loading into an image reproduction machine. The packaging apparatus includes (a) a cut sheet of light occluding and protective flexible member for wrapping over the flexible photoconductive belt loop. The cut sheet has a length L2 including a first end, a second end, and (iv) at least one loop tacking aperture formed through a second end portion thereof. The packaging apparatus also includes a first adhesive tape member applied over the second end portion, through the at least one loop tacking aperture, and onto a first end portion. The packaging apparatus further includes a plurality of packaging cores, and a second adhesive tape member applied over the second end and over a portion of the main body portion.

While the embodiment of the present invention disclosed herein is preferred, it will be appreciated from this teaching that various alternative, modifications, variations or improvements therein may be made by those skilled in the art, which are intended to be encompassed by the following claims:

What is claimed is:

1. Packaging apparatus for packaging a flexible photoconductive belt loop having a width W1 and circumference L1, so as to prevent light from shocking said flexible photoconductive belt loop during shipping and during loading into an image reproduction machine, said packaging apparatus comprising:

(a) a cut sheet of light occluding and protective flexible member for wrapping over an external surface of said flexible photoconductive belt loop, said cut sheet of light occluding and protective flexible member having a width W2, and a length L-2 including (i) a main body portion, (ii) a first end, (iii) a first end portion adjacent said main body portion and said first end, (iv) a second end, (v) a second end portion adjacent said main body portion and said second end, and (vi) at least one loop tacking aperture formed through said second end portion of said cut sheet of light occluding and protective member;

(b) a first adhesive tape member applied over said second end portion, through said at least one loop tacking aperture, and onto said first end portion of said cut sheet of light occluding and protective flexible member; and (c) a second adhesive tape member applied over said second end of said cut sheet of light occluding protective flexible member and over a portion of said main body portion of said cut sheet of light occluding protective flexible member when folded with said flexible photoconductive belt loop and lying underneath said second end of said light occluding protective flexible member.

2. The packaging apparatus of claim 1, wherein said light occluding protective flexible member comprises photo paper.

3. The packaging apparatus of claim 1, wherein said length L2 of said light occluding protective flexible member is significantly greater than said circumference L1 of said flexible photoconductive belt loop.

4. The packaging apparatus of claim 1, wherein said first adhesive tape includes an adhesive bottom surface and a printable top surface.

5. The packaging apparatus of claim 1, wherein said at least one loop tacking aperture is formed centered relative to said width W2.

6. The packaging apparatus of claim 1, wherein said second adhesive tape comprises a removable pull tab.

7. The packaging apparatus of claim 1, including a plurality of cylindrical packaging core members for supporting and forming a wrapped assembly of said flexible photoconductive belt loop and said light occluding protective flexible member into a tightly folded assembly thereof.

8. The packaging apparatus of claim 2, wherein said photo paper is black.

9. The packaging apparatus of claim 4, wherein said printable top surface includes printed instructions for handling said folded flexible photoconductive belt loop for installation in an image reproduction machine.

10. The packaging apparatus of claim 7, wherein said plurality comprises three.

11. The packaging apparatus of claim 7, wherein said plurality includes first and second cylindrical packaging cores located inside said flexible photoconductive belt loop for stretching and tensioning a wrapped assembly, of said flexible photoconductive belt loop and said light occluding protective flexible member, into a flat bed loop having a length approximately one-half L1.

12. The packaging apparatus of claim 7, wherein each of said cylindrical packaging cores is made of paper.

13. The packaging apparatus of claim 11, including a third cylindrical packaging core located outside said wrapped assembly for folding said wrapped assembly around one of said first and second cylindrical packaging cores into a tightly folded assembly thereof.

14. The packaging apparatus of claim 13, wherein each of said cylindrical packaging cores has a diameter selected such that said first, second and third cylindrical packaging cores will be linearly aligned when said flat bed loop is formed into said tightly folded assembly.

15. Packaging apparatus for packaging a flexible photoconductive belt loop having a width W1 and circumference L1, so as to prevent light from shocking said flexible photoconductive belt loop during shipping and during loading into an image reproduction machine, said packaging apparatus comprising:

(a) a cut sheet of light occluding and protective flexible member for wrapping over an external surface of said flexible photoconductive belt loop, said cut sheet of light occluding and protective flexible member having a width W2, and a length L-2 including (i) a main body portion, (ii) a first end, (iii) a first end portion adjacent said main body portion and said first end, (iv) a second end, (v) a second end portion adjacent said main body portion and said second end, and (vi) at least one loop tacking aperture formed through said second end portion of said cut sheet of light occluding and protective member;

(b) a plurality of cylindrical packaging core members for supporting and forming a wrapped assembly of said flexible photoconductive belt loop and said light occluding protective flexible member into a tightly folded assembly thereof;

(c) a first adhesive tape member applied over said second end portion, through said at least one loop tacking aperture, and onto said first end portion of said cut sheet of light occluding and protective flexible member; and (d) a second adhesive tape member applied over said second end of said cut sheet of light occluding protective flexible member and over a portion of said main body portion of said cut sheet of light occluding protective flexible member when folded with said flexible photoconductive belt loop and lying underneath said second end of said light occluding protective flexible member.

* * * * *